United States Patent [19]

Mann et al.

[11] Patent Number: 4,807,303

[45] Date of Patent: Feb. 28, 1989

[54] PROTECTIVE CLOTHING SYSTEM FOR COLD WEATHER

[75] Inventors: Joe A. Mann; Vincent J. Ambrosiani; Cynthia D. Wilder; Abdelfattah M. Seyam, all of Greensboro, N.C.

[73] Assignee: Burlington Industries, Inc., Greensboro, N.C.

[21] Appl. No.: 885,444

[22] Filed: Jul. 14, 1986

[51] Int. Cl.[4] ..... B32B 3/26; B32B 5/18

[52] U.S. Cl. ..... 2/69; 2/272; 428/71

[58] Field of Search ..... 2/272, 69; 428/71

[56] References Cited

U.S. PATENT DOCUMENTS

| | | | |
|---|---|---|---|
| 2,897,508 | 8/1959 | Bashore et al. | 2/93 |
| 2,976,539 | 3/1961 | Brown | 2/2 |
| 3,541,620 | 11/1970 | Chapuis | 2/272 X |
| 4,338,686 | 7/1982 | Bell | 2/93 |
| 4,495,661 | 1/1985 | Kamat | 2/272 X |
| 4,548,848 | 10/1985 | Shibata et al. | 139/420 X |
| 4,569,874 | 2/1986 | Kuznetz | 2/272 X |
| 4,690,847 | 9/1987 | Lassiter et al. | 428/71 |

OTHER PUBLICATIONS

"Without Fire or Shelter", Phillips Corporation, 1984.

"Keep Warm to Enjoy Winter," The Herald, p. 13, 11/29/84.

"The Mother Earth News", 91, pp. 160, 161, Jan./Feb. 1985.

Fieldbook, Boy Scouts of America, 1984, pp. 65-67, 76-89, 331-335.

"Cozy Quip" advertising brochure.

*Primary Examiner*—Louis K. Rimrodt

*Attorney, Agent, or Firm*—Nixon & Vanderhye

[57] ABSTRACT

Upper and lower body cold weather garments are provided which have excellent warmth, moisture permeability, wind resistance, and water resistance. The garment comprises an interior lining fabric, such as a loosely knit nylon lining, an outer fabric, and a layer of preponderantly open cell (e.g. polyurethane) foam at least ½ inch thick (preferably about one inch thick) between the interior lining fabric and the outer fabric, the components connected together by stitching at the edges of the garment. The outer fabric has air permeability of less than 15, and preferably less than 10, cubic feet per minute per square foot at 0.5 inches head of water, and has moisture vapor transmission of at least 1,000 grams per square meter per 24 hours. The outer or shell fabric preferably is woven from a fine denier, multi-filament, polyester yarn. The upper and lower body garments, when worn as the only cold weather protecting garments and without any other garments having poor moisture vapor transmission, provide extremely effective cold weather comfort even in windy environments.

29 Claims, 3 Drawing Sheets

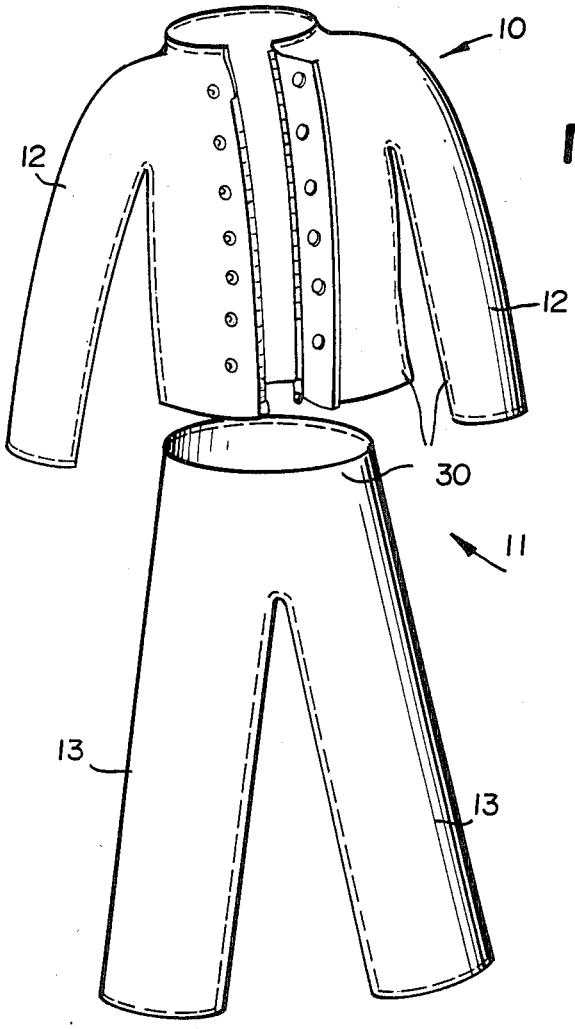
FIG. 1
FIG. 2
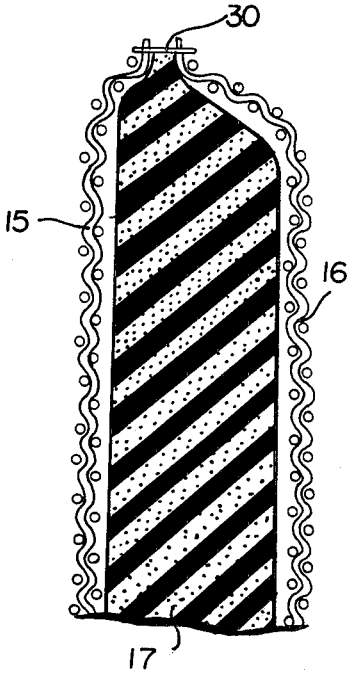
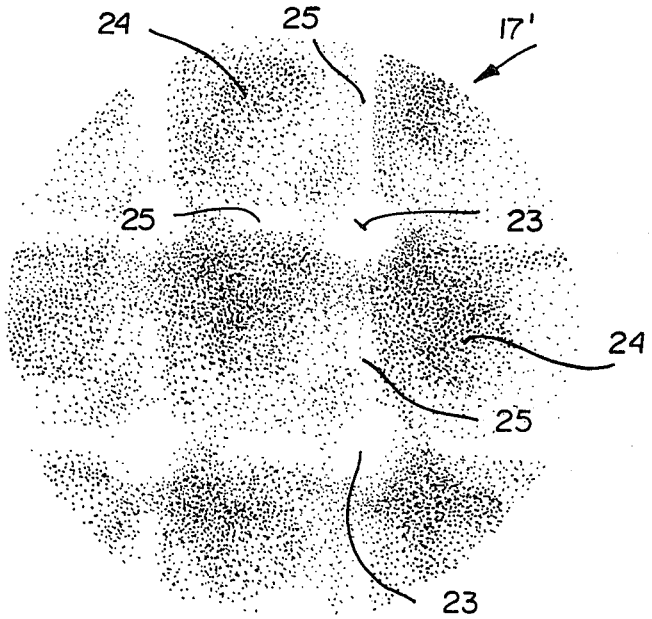
FIG. 6

FIG. 4
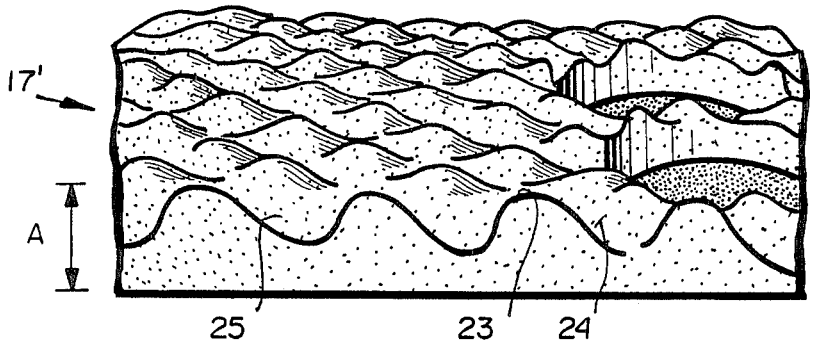
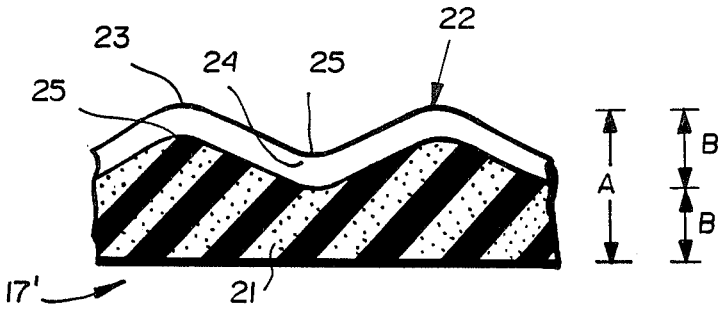
FIG. 5

PROTECTIVE CLOTHING SYSTEM FOR COLD WEATHER

BACKGROUND AND SUMMARY OF THE INVENTION

In extremely cold conditions, the two most important requirements for clothing—to provide humans with the ability to survive and/or be comfortable—are the necessity of reducing heat loss from the body, and permitting the controlled transmission of moisture produced by perspiration. Traditionally, the reduction of heat loss has been accomplished by wearing heavy garments and/or by putting on multiple layers of garments. The transmission of moisture has been provided for in various ways, such as by wearing of vapor permeable garments, providing ventilation at the cuffs or collars, deliberately providing vent holes in the garments, etc. Within approximately the last decade and a half, two different systems have emerged for providing enhanced comfort, and/or survivability, even under extremely cold conditions and harsh environments.

One of the two cold weather garment systems that is most accepted is known, for civilian garments, as the Patagonia system, and its closely related military counterpart is the ECWCS system. These are layered systems consisting of three or more separate garments that are worn one over the other, each set consisting of an upper body series of layers, and a lower body series of layers. The outer set in the ECWCS system is of Gore-Tex laminated polytetrafluorethylene fabric.

Another accepted and very successful "cold weather system", which has been proven effective in a wide variety of cold weather climates, is known as the Phillips system, and was developed by the well known outdoorsmen J. G. Phillips, Jr. and Sr. This system comprises unitary garments, rather than layers. The garment is made up of three components an outer or "shell" layer of military nylon camouflage fabric selected for its ruggedness and high permeability to air and moisture vapor; an approximately one inch thick layer of soft and flexible polyurethane open cell foam; and an interior woven or knit lining fabric. The three components are sewn together to form a unitary garment. As a single garment system, rather than a multi-layered system, the Phillips system has a number of advantages over the ECWCS system. However the Phillips system has one significant drawback, and that is low wind resistance. The low wind resistance of the Phillips system limits the versatility of this otherwise very effective system.

Despite the fact that the Phillips system has been known and used commercially for more than a decade and a half, heretofore its low wind resistance problem has not been solved. However, according to the present invention, a cold weather garment, and a method of utilization of the cold weather garments, have been provided which solve the low wind resistance problem of the Phillips system, while retaining all of the other advantages thereof The single-set system of garments (that is an upper body garment including arm portions, and a lower body garment comprising leg portions) has excellent warmth, moisture permeability, wind resistance, and water resistance properties.

The most significant distinction between the invention and the Phillips system is the composition of the outer or shell fabric. The outer fabric of the garment according to the present invention has extremely low air permeability, while still having very high moisture vapor transmission. That is, the air permeability of the outer fabric according to the invention is less than 15 cubic feet per minute per square foot at 0.5 inches head of water, and preferably is less than 10 cubic feet per minute per square foot. Despite this low air permeability, the outer fabric of the garment according to the present invention has a moisture vapor transmission of at least 1,000 grams per square meter per 24 hours.

The preferred outer fabric according to the invention is a woven fabric, constructed from a fine denier, multifilament, synthetic yarn (preferably polyester yarn) which is woven into a high density construction with controlled air porosity and moisture vapor transport properties. One commercially available fabric that is eminently suitable as the outer fabric according to the invention is sold by Burlington Industries, Inc. of Greensboro, N.C. under the trademark "VERSATECH".

The garments according to the invention comprise, in addition to the outer fabric specified above, an interior lining, which may be the same as for the Phillips system, and preferably comprises a loosely knit nylon or polyester tricot fabric.

Between the inner and outer fabrics is at least a ½ inch layer, and preferably about a one inch layer, of open cell polyurethane foam, of the same type as in the Phillips system. Alternatively, the foam can comprise a convoluted foam, which has a number of advantages compared to conventional parallel sided foam blocks, including increased flexibility, reduced material and weight, and added surface area for moisture transfer during sweating.

These three components of the garments according to the invention are connected together by stitching at the edges of the garment. That is, the outer fabric, foam, and inner fabric are sewn together around the edges, and the foam is not in any way bonded to the shell or the liner by adhesive, or in any other manner, since such additional bonding may reduce the effectiveness of the garment for providing warmth or moisture permeability.

The garment system according to the present invention is eminently successful even in harsh windy environments. For instance even with a temperature in the range of −20° to +10° F., with the wind continuous at 20–30 miles per hour, one wearing the garment system according to the present invention can remain warm and comfortable. Protection is also provided under more moderate conditions, such as 10° F. to 50° F.

According to the present invention there also is provided a method of protecting a human against cold weather. The method according to the invention comprises the following steps Constructing an upper body garment for covering the human's upper body and arms, the upper body garment having arm portions, and the garment constructed by disposing a layer of open cell foam at least ½ inch thick between an interior lining fabric and an outer fabric having an air permeability of less than 10 cubic feet per minute per square foot at 0.5 inches head of water, and having a moisture vapor transmission at least 1,000 grams per square meter per 24 hours; by stitching around the edges of the garment to hold the foam, lining, and outer fabric together at the garment edges and elsewhere if required; constructing a lower body garment, having leg portions, in the same manner as the construction of the upper body garment;

and, providing the human with the upper body garment and the lower body garment covering the human's body, arms, and legs, so that the upper body garment and lower body garment are the only cold weather garments protecting the human's body, arms, and legs, and so that the human has no garment on the body, arms, or legs that has poor moisture vapor transmission.

It is the primary object of the present invention to provide improved and effective cold weather garments, and a method of utilization thereof to protect a human from cold weather. This and other objects of the invention will become clear from an inspection of the detailed description of the invention, and from the appended claims.

BRIEF DESCRIPTION OF THE DRAWINGS

FIG. 1 is a perspective schematic view of exemplary upper and lower body garments constructed according to the present invention;

FIG. 2 is a cross-sectional view of a portion of one of the garments of FIG. 1, showing the construction of the three components;

FIG. 4 is a top perspective view of an exemplary convoluted foam that may be utilized in the garment of FIGS. 1 and 2; and FIGS. 5 and 6 are side cross-sectional, and top plan views, respectively, of the convoluted foam of FIG. 4.

DETAILED DESCRIPTION OF THE DRAWINGS

Figure 3:
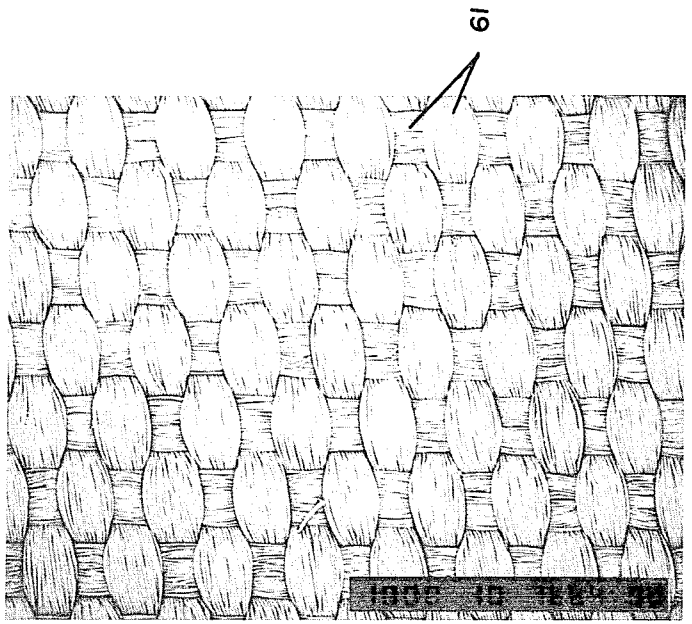
FIG. 3 is a photograph, at a magnification of 50 times, showing an exemplary outer fabric utilized in the garment of FIGS. 1 and 2.

Exemplary cold weather garments according to the invention are illustrated schematically in FIG. 1, an upper body garment being illustrated by reference numeral 10, and the lower body garment by reference numeral 11. The upper body garment 10 protects the upper part of the wearer's body, and has arm portions 12 which cover the wearer's arms. The lower body garment 11 protects the lower portion of the wearer's body, and includes leg portions 13. Utilizing the garments 10, 11, the wearer needs no other garments in order to provide sufficient cold weather protection for the wearer's body, arms, and legs, although additional garments will be utilized to protect the wearer's hands, feet, and head. While no other additional garments are necessary for cold weather protection, the wearer can, if desired, wear underwear, or like garments, although it is necessary that the wearer avoid wearing any other type of garment (whether inner or outer) which has poor moisture vapor transmission properties.

The construction of each of the garments 10, 11, is illustrated in FIG. 2, each of the garments comprising (or consisting of) three layers, comprising an outer or shell fabric layer 15, an inner fabric layer 16, and a layer of foam 17 disposed between the fabric layers 15, 16.

The outer fabric layer 15 is, according to the present invention, the component of the garment which provides the desired increased wind resistance that is achieved according to the invention. The fabric 15 may be any suitable fabric which has air permeability of less than 15 cubic feet per minute per square foot at 0.5 inches head of water, and preferably has less than 10 $ft^3/min./ft^2$. Despite its low air permeability, the fabric 15 must has good moisture vapor transmission, that is it should be at least about 1,000 grams per square meter per 24 hours.

One particular fabric 15 according to the present invention, which has the desired air permeability and moisture vapor transmission properties, comprises a high density woven fabric, woven from fine denier, multi-filament, synthetic yarn (e.g. polyester yarn). Such a fabric is available commercially from Burlington Industries, Inc. under the trademark "VERSATECH". A piece of VERSATECH fabric, at a magnification of 50 times, is illustrated in the photograph of FIG. 3. Note in particular the fine denier multi-filament yarns 19, which make up the weave of the fabric.

The inner fabric 16 may be of any suitable conventional type. For instance both knit or woven fabrics can be utilized. The major purpose of the inner fabric 16 is just to prevent the foam 17 from directly contacting the body, and allowing free moisture vapor transmission from the body to the foam. One particular fabric that is especially suitable for the inner lining 16 is a loosely knit nylon or polyester tricot fabric.

The foam 17 of the garment may be of any suitable construction, and preferably is a preponderantly open cell, soft and flexible polyurethane foam, such as is utilized in the Phillips system. Foam layer 17 has a thickness of at least ½ inch, and preferably a thickness of at least about ¾ of an inch, and desirably a thickness of about one inch. While the foam may have a uniform thickness, as is conventional in the Phillips system and as is illustrated for the layer 17 in FIG. 2, it is advantageous to provide the foam having a convoluted construction, as illustrated in FIGS. 4 through 6.

The convoluted foam 17' of FIGS. 4 through 6 has a first face, 21, which is adapted to abut the outer fabric 16, and a second, convoluted face 22, having peaks 23 and valleys 24, the peaks 23 adapted to abut the inner lining fabric 16. For the particular embodiment illustrated in the drawings, note that the peaks 23 are disposed in a substantially linear grid-like arrangement, with ridges 25 interconnecting the peaks 23, and with four peaks 23 and associated ridges 25 surrounding each valley 24. In the preferred embodiment of the invention, the entire thickness A (see FIG. 5 in particular) of the foam layer is about one inch, while the thickness of the base of the foam layer 17', and the spacing between the bottom of each valley and the top of each peak, are each approximately of the dimension B, which is approximately ½ inch. One such suitable convoluted foam is commercially available from Technical Foam Products of Charlotte, N.C.

The convoluted foam layer 17' has a number of advantages. It increases the flexibility and reduces the material and weight of the entire garment. Also, the peak and valley surface 22 provides added surface area for moisture transfer during sweating since moisture transfer includes permeation of water vapor.

The three layers of the garments according to the invention are connected together by suitable connecting means to form the garment. A preferred form that the connecting means takes is illustrated schematically in FIGS. 1 and 2, and comprises stitching 30, the stitching 30 being provided at the edges of the garment for stitching the outer fabric 15 and inner lining 16 to the foam layer 17. Stitching 30 is provided wherever necessary in order to construct a particular garment. If desired, an additional ridge of material may be provided at the edges of the garment at the area of the stitching.

In actual tests conducted utilizing the garments according to the invention, in an environment in which the temperature was in the range of −20° to 10° F. and the wind was continuous at 20–30 miles per hour, the invention was demonstrated to be superior to the ECWCS system, and the Phillips system. After four days in the ECWCS garment, the tester was severely chilled and was on the verge of hypothermia, with a core temperature of about 91° F. The tester then switched to the garments according to the invention, with a foam layer 17 approximately one inch thick. The tester's body temperature rose within 2.5 hours to 101° F, and leveled off at 98.6° F. within 15 hours. The tester remained warm and comfortable over the next five days. The tester also evaluated the Phillips system, which is entirely suitable for the temperature range −20° to +10° F. if the wind is low. However, because of the low wind resistance of the Phillips system, he was quite uncomfortable in the continuous wind of 20–30 miles per hour.

Laboratory tests were also done comparing the moisture vapor transport, and air permeability of the shell fabrics of the invention, the Phillips system, and the ECWCS system, and also comparing the garments according to the invention, the Phillips system, and the ECWCS system. Those laboratory determinations are as follows:

| Shell Fabric | MVT g/m²-24 hours | Air Permeability ft³/min/ft² | Weight oz/yd² |
|---|---|---|---|
| VERSATECH (invention) | 1610 | 1.70 | 2.75 |
| Camouflage fabric (Phillips) | 1470 | 44.5 | 2.75 |
| Gore-Tex (ECWCS) | 460 | 0.0 | 5.70 |

| Garment Sample | MVT g/m²-24 hours | Air Permeability ft³/min/ft² |
|---|---|---|
| VERSATECH/one-inch foam/lining fabric composite garment of invention | 676 | 1.99 |
| Camouflage fabric/one-inch foam/lining fabric composite garment of Phillips | 554 | 35.6 |
| ECWCS composite garment | 521 | 0.0 |

While the laboratory results set forth above with respect to the composite garments may not be entirely accurate due to difficulties in testing, it is believed that the results are generally accurate and confirm what is clear from the subjective tests done by the cold weather expert tester, namely that the system according to the invention can be considered superior to the ECWCS and Phillips systems.

It will thus be seen that according to the present invention a method and garment system have been provided for protecting a human from cold weather, even under windy conditions. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent garments, systems, and procedures.

A series of nylon polyamide fabrics were prepared as candidate shell fabrics for the improved protective clothing system. The structures and significant properties were as follows:

| FABRIC NO. | YARN DENIERS WARP | YARN DENIERS FILLING | YARN COUNT WARP × FILLING | WT. OZ/YD² | M.V.T. G/M²-24 HRS | AIR POROSITY FT³/MIN/FT² |
|---|---|---|---|---|---|---|
| 1 | 210 | 3 × 70/66 | 79 × 61 | 4.94 | 1333 | 9.8 |
| 2 | 210 | 330 | 79 × 59 | 5.69 | 1212 | 5.9 |
| 3 | 330 | 3 × 70/66 | 64 × 59 | 5.82 | 1273 | 13.2 |
| 4 | 330 | 330 | 63 × 57 | 6.25 | 1212 | 9.9 |

All of these nylon fabrics meet the criteria for shell fabrics of this invention.

What is claimed is:

1. A cold weather garment comprising: an interior synthetic lining fabric; an outer fabric; a layer of preponderantly open cell foam at least ½ between the interior lining fabric and the outer fabric; and the lining, foam layer, and outer fabric connected together by connecting means to form a synthetic garment; and wherein:

the outer fabric comprises a fabric having an air permeability of less than 15 cubic feet per minute per square foot at 0.5 inches head of water, and having a moisture vapor transmission of at least 1,000 grams per square meter per 24 hours.

2. A garment as recited in claim 1 wherein the outer fabric is a woven fabric, woven from a fine denier, multi-filament, synthetic yarn so that it has a high density.

3. A garment as recited in claim 2 wherein the synthetic yarn is polyester.

4. A garment as recited in claim 2 wherein the foam comprises polyurethane foam approximately one inch thick.

5. A garment as recited in claim 4 wherein the lining fabric comprises a fabric loosely knit from synthetic fiber.

6. A garment as recited in claim 5 wherein said connecting means comprises stitching disposed around the edges of the garment and connecting the outer fabric to the foam and the lining fabric to the foam at the edges of the garment.

7. A garment as recited in claim 2 wherein the synthetic yarn is polyamide.

8. A garment as recited in claim 7 wherein the outer fabric is a warp yarn count of between about 63–79, and a filling yarn count of between about 57–61, respectively.

9. A garment as recited in claim 2 wherein the outer fabric is a woven fabric, woven from a fine denier, multi-filament, polyester or polyamide yarn so that it has a high density.

10. A garment as recited in claim 1 wherein said connecting means comprises stitching around the edges of the garment and connecting the outer fabric to the foam and the lining fabric to the foam at the edges of the garment.

11. A garment as recited in claim 1 wherein the foam having an effective thickness comprises polyurethane foam approximately one inch, and wherein the air permeability of the outer fabric is less than 10 ft³/min./ft².

12. A garment as recited in claim 11 wherein the lining fabric comprises a fabric loosely knit from synthetic fiber.

13. A garment as recited in claim 1 wherein the outer fabric comprises a fabric having an air permeability of less than 15 cubic feet per minute per square foot at 0.5 inches head of water, and having a moisture vapor transmission of at least 1,000 grams per square meter per 24 hours.

14. A garment as recited in claim 1 wherein the foam comprises polyurethane foam at least about ¼ inch thick.

15. A cold weather garment comprising: an interior lining fabric; an outer fabric; a layer of preponderantly open cell foam with an effective thickness at least ¾ inch thick between the interior lining fabric and the outer fabric; and the lining, foam, and outer fabric connected together by connecting means to form a composite garment; and wherein the outer fabric comprises a woven fabric comprising a high density fabric woven from a fine denier, multi-filament, synthetic yarn.

16. A garment as recited in claim 15 wherein the synthetic yarn is polyester.

17. A garment as recited in claim 15 wherein said connecting means comprises stitching disposed around the edges of the garment and connecting the outer fabric to the foam and the lining fabric to the foam at the edges, and only at the edges, of the garment.

18. A garment as recited in claim 15 wherein the lining fabric comprises a fabric loosely knit from synthetic fiber.

19. A cold weather garment as recited in claim 15 wherein the outer fabric is woven from polyamide yarn, having a warp yarn count of between about 63–79, and a filling yarn count of between about 57–61.

20. A method of protecting a living human being from cold, comprising the steps of:

constructing an upper body garment for covering the human's upper body and arms, the upper body garment having arm portions, and the garment constructed by disposing a layer of preponderantly open cell foam at least ½ inch thick between an interior lining fabric and an outer fabric having an air permeability of less than 10 cubic feet per minute per square foot at 0.5 inches head of water, and having a moisture vapor transmission at least 1,000 grams per square meter per 24 hours, by stitching around the edges of the garment to hold the foam, lining, and outer fabric together at the garment edges;

constructing a lower body garment, having leg portions, in the same manner as the construction of the upper body garment; and providing the human with the upper body garment and the lower body garment covering the human's body, arms, and legs, so that the upper body garment and lower body garment are the only cold weather garments protecting the human's body, arms, and legs, and so that the human has no garment on the body, arms, or legs that has poor moisture vapor transmission.

21. A method as recited in claim 20 wherein said constructing steps are practices by utilizing as the outer fabric a woven, high density fabric, which is woven from a fine denier, multi-filament synthetic yarn.

22. A method as recited in claim 21 wherein said constructing steps are practiced so as to provide the foam layer approximately one inch thick.

23. A method as recited in claim 22 wherein said constructing steps are practiced utilizing a loosely knit synthetic material fabric as the lining fabric.

24. A cold weather upper body garment,, including arm portions, consisting essentially of an interior lining fabric;

an outer fabric of fine denier multi-filament synthetic yarn woven into a high density fabric;

a layer of polyurethane foam approximately one inch thick between the interior lining fabric and the outer fabric; and stitching connecting the lining, outer fabric, and foam together at the garment edges.

25. A lower body garment having leg portions, and adapted to be worn in combination with the upper body garment recited in claim 24, said lower body garment consisting essentially of:

an interior lining fabric;

an outer fabric of fine denier multi-filament synthetic yarn woven into a high density fabric;

a layer of polyurethane foam approximately one inch thick between the interior lining fabric and the outer fabric; and stitching connecting the lining, outer fabric, and foam together at the garment edges.

26. A garment as recited in claim 25 wherein said outer fabric yarn is selected from the group consisting of polyester and polyamide.

27. A garment as recited in claim 24 wherein said outer fabric yarn is selected from the group consisting of polyester and polyamide.

28. A cold weather garment comprising: an interior synthetic lining fabric; a synthetic outer fabric; a layer of preponderantly open cell foam between the interior lining fabric and the outer fabric; the lining, foam layer, and outer fabric connected together by connecting means to form a garment; and the garment having an MVT value of at least 500 grams per square meter per 24 hours, and an air permeability of less than 15 cubic feet per minute per square foot at 0.5 inches head of water.

29. A cold weather garment comprising:

an interior synthetic lining fabric;

an outer fabric;

a layer of preponderantly open cell foam between the interior lining fabric and the outer fabric;

the lining, foam layer, and outer fabric connected together by connecting means to form a garment; and wherein the outer fabric comprises a woven fabric, woven from polyamide yarn having a warp count of between about 63–79, and the filling yarn count of between about 57–61, and having an air permeability of less than 15 cubic feet per minute per square foot at 0.5 inches head of water, and having a moisture vapor transmission of at least 1,000 grams per square meter per 24 hours.

* * * * *

UNITED STATES PATENT AND TRADEMARK OFFICE

CERTIFICATE OF CORRECTION

PATENT NO. : 4,807,303

DATED : February 28, 1989

INVENTOR(S) : MANN et al.

It is certified that error appears in the above-identified patent and that said Letters Patent is hereby corrected as shown below:

Col. 1, line 38 - after "components", add --:--; line 60 - after "thereof", add --.--.
Col. 2, line 55 - after "steps", add --:--.
Col. 3, line 66 - delete "has" and insert therefor --have--.
Col. 4, line 33 - delete "16" and insert therefor --15--.
Col. 6, line 24 - after "½", insert --inch thick--; line 53 - delete "is" and insert therefor --has--; lines 66 and 67 which read "having an effective thickness comprises polyurethane foam approximately one inch," should read --Comprises polyurethane foam having an effective thickness of approximately one inch--.
Col. 7, line 14 - after "thickness", add --of--; line 15 - delete "thick"; line 62 - delete "practices" and insert therefor --practiced--.
Figure 5 - the lead line for numeral 21 should terminate at the lower edge of foam 17'.

Signed and Sealed this

Ninth Day of January, 1990

*Attest:*

JEFFREY M. SAMUELS

*Attesting Officer*

*Acting Commissioner of Patents and Trademarks*